US011041311B1

(12) United States Patent
Duran

(10) Patent No.: US 11,041,311 B1
(45) Date of Patent: Jun. 22, 2021

(54) METAL BLOCKING WITH COPING WITH CLEAT

(71) Applicant: Bernardo Duran, Miami, FL (US)

(72) Inventor: Bernardo Duran, Miami, FL (US)

( * ) Notice: Subject to any disclaimer, the term of this patent is extended or adjusted under 35 U.S.C. 154(b) by 0 days.

(21) Appl. No.: 17/109,292

(22) Filed: Dec. 2, 2020

(51) Int. Cl.
*E04D 3/38* (2006.01)
*E04D 3/40* (2006.01)

(52) U.S. Cl.
CPC ..... *E04D 3/405* (2013.01)

(58) Field of Classification Search
CPC ..... E04D 3/405
See application file for complete search history.

(56) References Cited

U.S. PATENT DOCUMENTS 3,862,531 A * 1/1975 Attaway ..... E04D 3/405 52/300
5,893,247 A * 4/1999 Hickman ..... E04F 19/02 52/300
6,237,293 B1 5/2001 Gembala
6,421,971 B1 7/2002 Gembala
2007/0256371 A1* 11/2007 Gembala ..... E04D 3/405 52/96

* cited by examiner

*Primary Examiner* — Patrick J Maestri
(74) *Attorney, Agent, or Firm* — Albert Bordas, P.A.

(57) ABSTRACT

A metal blocking with coping with cleat having a coping cap with a cap top flange, and first and second side flanges defining first and second channels respectively at respective ends; and a coping cleat having first and second top flanges, a corner anchoring flange, and an intermediate anchoring flange. The first channel is defined by a first exterior cleat strip, a first base cleat strip, and a first interior cleat strip. The second channel is defined by a second exterior cleat strip, a second base cleat strip, and a second interior cleat strip. The first side flange has a first predetermined height and the second side flange has a second predetermined height, wherein the first predetermined height is shorter than the second predetermined height.

18 Claims, 5 Drawing Sheets

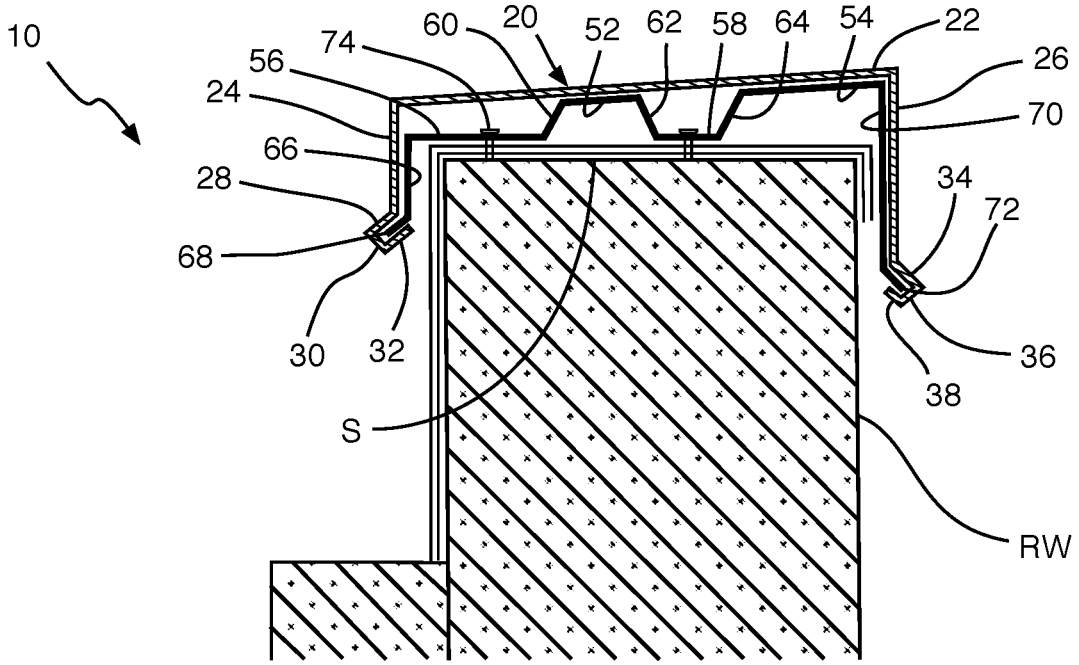
Fig. 3
Fig. 4
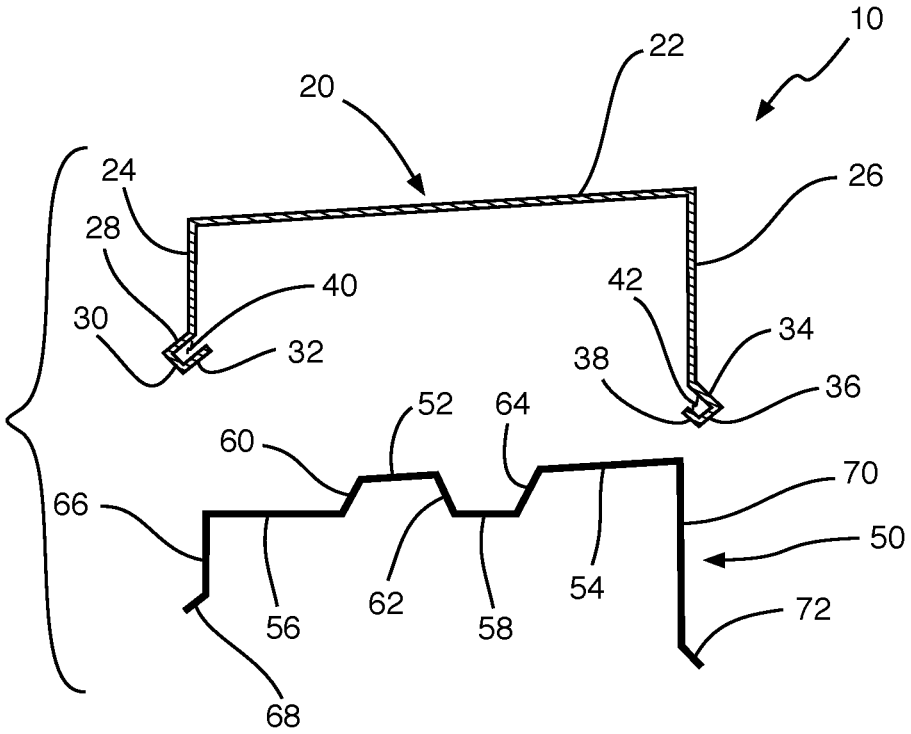

METAL BLOCKING WITH COPING WITH CLEAT

BACKGROUND OF THE INVENTION

1. Field of the Invention

The present invention relates to metal blocking systems, and more particularly, to continuous cleat coping systems.

2. Description of the Related Art

Applicant believes that one of the closest references corresponds to U.S. Pat. No. 6,237,293 B1 issued to Henry Gembala on May 29, 2001 for Alternative blocking for roof systems. However, it differs from the present invention because Gembala teaches a blocking assembly that includes one or more pre-formed component structures fabricated from a non-corrosive, durable material, each of the component structures including an anchoring flange for attachment to the roof structure, an upper flange defining a mounting base for attachment of various roofing components, materials and/or equipment thereto, and an intermediate portion between the anchoring flange and the upper flange creating depth therebetween to accommodate insulation or lightweight concrete. The intermediate portion is provided with vent holes for venting gases and moisture, which accumulate within the roof structure, thereby reducing the likelihood of premature roof failure.

Applicant believes that another reference corresponds to U.S. Pat. No. 6,421,971 B1 issued to Henry Gembala on Jun. 23, 2002 for Edge closure with cant for roof systems. However, it differs from the present invention because Gembala teaches an integral, pre-formed edge closure fabricated from a non-corrosive, durable material that include an anchoring flange for attachment to a roof structure, an upper flange, an intermediate panel spanning between the anchoring flange and the upper flange, a cant panel positioned at an acute angle relative to the upper flange to define a cant strip along a length of the edge closure, and a mounting strip above the cant panel for securing the edge closure to a concrete parapet or other adjoining vertical wall on a roof structure. The anchoring flange and upper flange are spaced apart for receiving a thickness of insulation of lightweight concrete therebetween. The intermediate panel is provided with vent holes for venting gasses and moisture, which accumulate within the roof structure, thereby reducing the likelihood of premature roof failure.

Other patents describing the closest subject matter provide for a number of more or less complicated features that fail to solve the problem in an efficient and economical way. None of these patents suggest the novel features of the present invention.

SUMMARY OF THE INVENTION

The present invention is a metal blocking with coping with cleat comprising a coping cap having a cap top flange, and first and second side flanges defining first and second channels respectively at respective ends; and a coping cleat having first and second top flanges, a corner anchoring flange, and an intermediate anchoring flange.

The first channel is defined by a first exterior cleat strip, a first base cleat strip, and a first interior cleat strip. The second channel is defined by a second exterior cleat strip, a second base cleat strip, and a second interior cleat strip.

The first side flange has a first predetermined height and the second side flange has a second predetermined height, wherein the first predetermined height is shorter than the second predetermined height. The first and second exterior cleat strips extend outwardly from the first and second side flanges respectively. The first and second base cleat strips are perpendicular to the first and second exterior cleat strips respectively, and to the first and second interior cleat strips respectively. The first and second exterior cleat strips are relatively parallel to the first and second interior cleat strips respectively. The first interior cleat strip comprises a third predetermined height and the second interior cleat strip comprises a fourth predetermined height, whereby the fourth predetermined height is shorter than the third predetermined height.

The coping cleat further comprises first and second lateral flanges having first and second locking tabs respectively, whereby the first and second locking tabs extend outwardly. The first top flange is positioned between the corner anchoring flange and the intermediate anchoring flange. The first lateral flange perpendicularly extends from the corner anchoring flange, and the second lateral flange perpendicularly extends from the second top flange. The intermediate anchoring flange is positioned between the first top flange and the second top flange.

The corner anchoring flange has a first predetermined width and the intermediate anchoring flange has a second predetermined width, wherein the first predetermined width is wider than the second predetermined width. The first top flange has a third predetermined width and the second top flange has a fourth predetermined width, wherein the fourth predetermined width is wider than the third predetermined width. The coping cleat further comprises first and second panels extending from the corner anchoring flange and the intermediate anchoring flange respectively to the first top flange. The coping cleat further comprises a third panel extending from the intermediate anchoring flange to the second top flange. The first lateral flange has a fifth predetermined height and the second lateral flange comprises a sixth predetermined height, wherein the fifth predetermined height is shorter than the sixth predetermined height.

The cleat coping is mounted onto a surface having a roof wall, whereby first lateral flange is positioned at an interior side of the roof wall. The cleat coping is mounted onto the surface having the roof wall through the corner anchoring flange and the intermediate anchoring flange. The coping cap is secured onto the cleat coping, whereby the first side flange is positioned at the interior side of the roof wall, and the second side flange is secured at an exterior side of the roof wall onto the second lateral flange, wherein the coping cap is first secured onto the cleat coping at the exterior side, whereby the second channel receives the second locking tab. Once the coping cap is secured onto the coping cleat that is mounted onto the surface having the roof wall, the cap top flange, and the first and second top flanges are relatively parallel and define a predetermined angle with respect to the surface.

It is therefore one of the main objects of the present invention to provide a metal blocking with coping with cleat having a coping cap and a coping cleat.

It is another object of this invention to provide a metal blocking with coping with cleat for surfaces comprising roof walls.

It is another object of this invention to provide a metal blocking with coping with cleat that is efficient for carrying, transporting, and installation.

It is another object of this invention to provide a metal blocking with coping with cleat, which is of a durable and reliable construction.

It is yet another object of this invention to provide a metal blocking with coping with cleat that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 is a cut view taken along lines 3-3 from FIG. 1.

FIG. 4 is a front view of the coping cap disassembled from the coping cleat.

DETAILED DESCRIPTION OF THE PREFERRED EMBODIMENT

Figure 1:
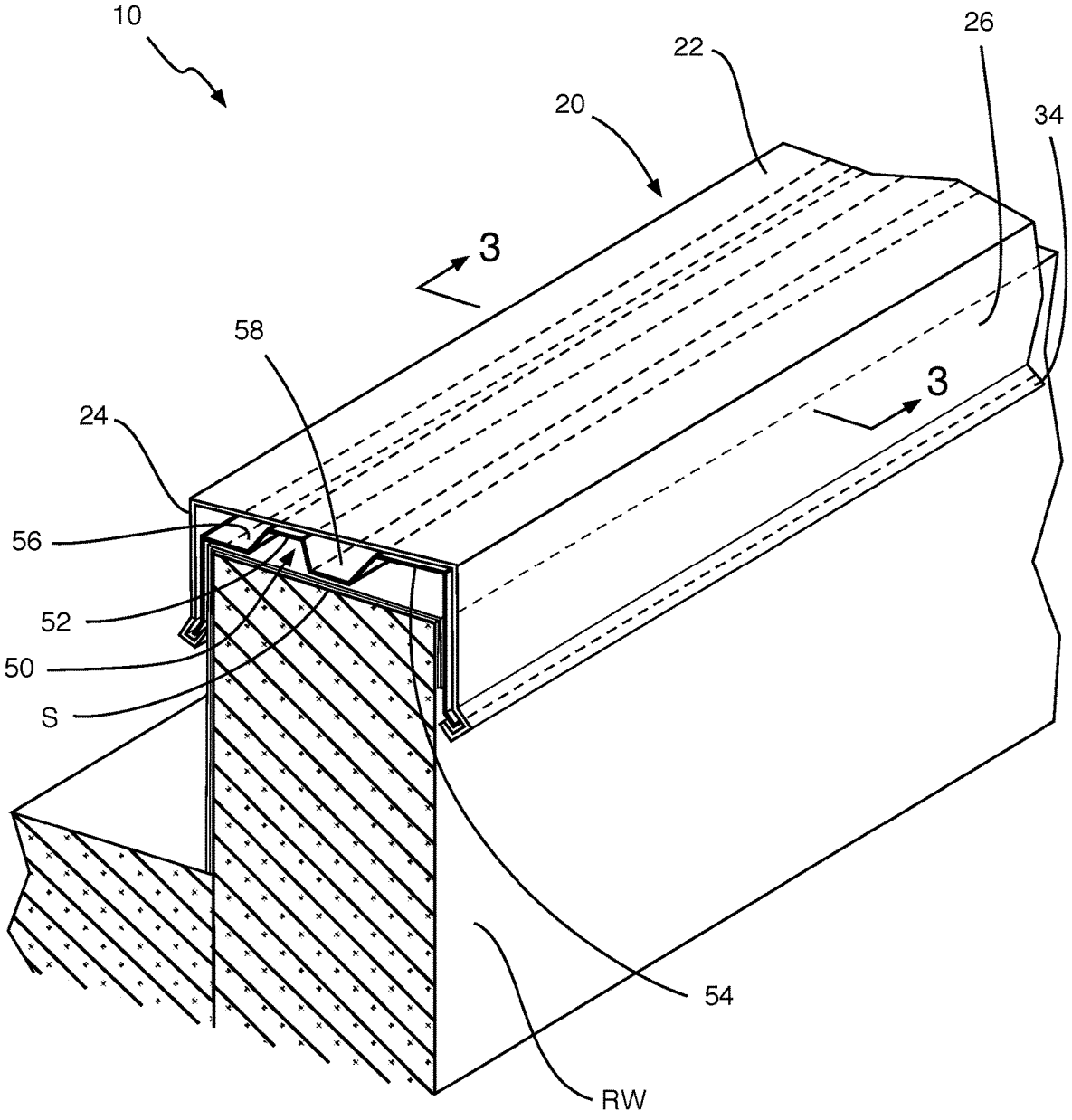
FIG. 1 is a first isometric view of the present invention having a coping cap secured onto a coping cleat that is mounted onto a surface.

Referring now to the drawings, the present invention is a metal blocking with coping with cleat, and is generally referred to with numeral 10. It can be observed that it basically includes coping cap 20 and coping cleat 50.

Figure 2:
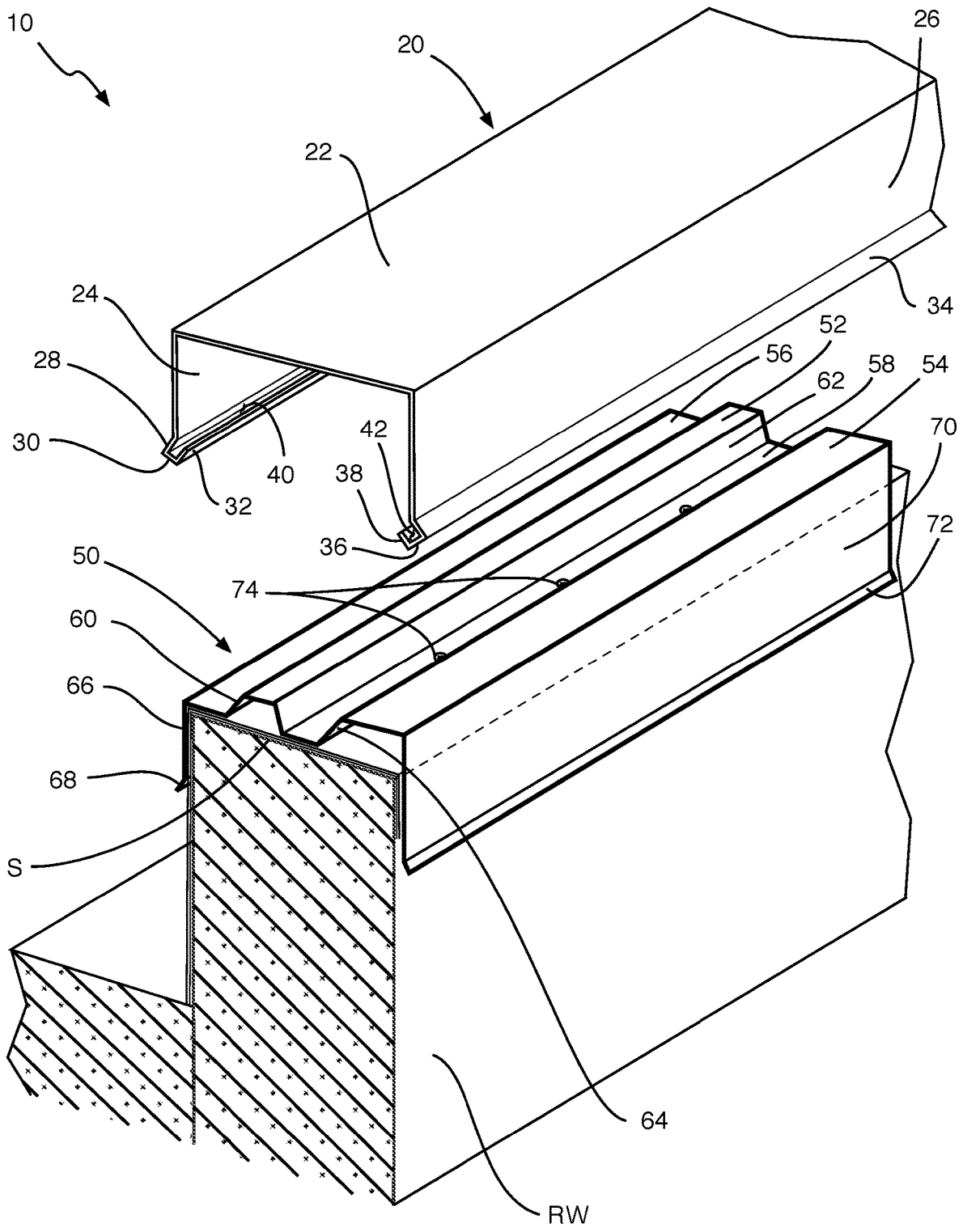
FIG. 2 is a second isometric view of the present invention having the coping cap disassembled from the coping cleat that is mounted onto the surface.

As seen in FIGS. 1 and 2, coping cap 20 comprises cap top flange 22, and first and second side flanges 24 and 26. First and second side flanges 24 and 26 define first and second channels 40 and 42 at respective ends. Coping cleat 50 comprises first and second top flanges 52 and 54, corner anchoring flange 56, and intermediate anchoring flange 58. Coping cleat 50 further comprises first and second lateral flanges 66 and 70. First lateral flange 66 comprises locking tab 68 and second lateral flange 70 comprises locking tab 72. Locking tabs 68 and 72 extend outwardly from lateral flanges 66 and 70 respectively.

As seen in FIGS. 3 and 4, first channel 40 is defined by first exterior cleat strip 28, first base cleat strip 30, and first interior cleat strip 32 forming a first U-shape configuration. Second channel 42 is defined by second exterior cleat strip 34, second base cleat strip 36, and second interior cleat strip 38 forming a second U-shape configuration. First side flange 24 has a first predetermined height and second side flange 26 has a second predetermined height, wherein the first predetermined height is shorter than the second predetermined height.

Exterior cleat strips 28 and 34 extend outwardly from first and second side flanges 24 and 26 respectively. First and second base cleat strips 30 and 36 are perpendicular to first and second exterior cleat strips 28 and 34 respectively, and to first and second interior cleat strips 32 and 38 respectively. First and second exterior cleat strips 28 and 34 are relatively parallel to first and second interior 32 and 38 cleat strips respectively. First interior cleat strip 32 comprises a third predetermined height and second interior cleat strip 38 comprises a fourth predetermined height, whereby the fourth predetermined height is shorter than the third predetermined height.

First top flange 52 is positioned between corner anchoring flange 56 and intermediate anchoring flange 58. First lateral flange 66 perpendicularly extends from corner anchoring flange 56, and second lateral flange 70 perpendicularly extends from second top flange 54. Intermediate anchoring flange 58 is positioned between first top flange 52 and second top flange 54.

Corner anchoring flange 56 has a first predetermined width and intermediate anchoring flange 58 has a second predetermined width, wherein the first predetermined width is wider than the second predetermined width. First top flange 52 has a third predetermined width and second top flange 54 has a fourth predetermined width, wherein the fourth predetermined width is wider than the third predetermined width. Coping cleat 50 further comprises first and second panels 60 and 62 extending from corner anchoring flange 56 and intermediate anchoring flange 58 respectively to first top flange 52. Coping cleat 50 further comprises third panel 64 extending from intermediate anchoring flange 58 to second top flange 54. First lateral flange 66 has a fifth predetermined height and second lateral flange 70 has a sixth predetermined height, wherein the fifth predetermined height is shorter than the sixth predetermined height.

Figure 5:
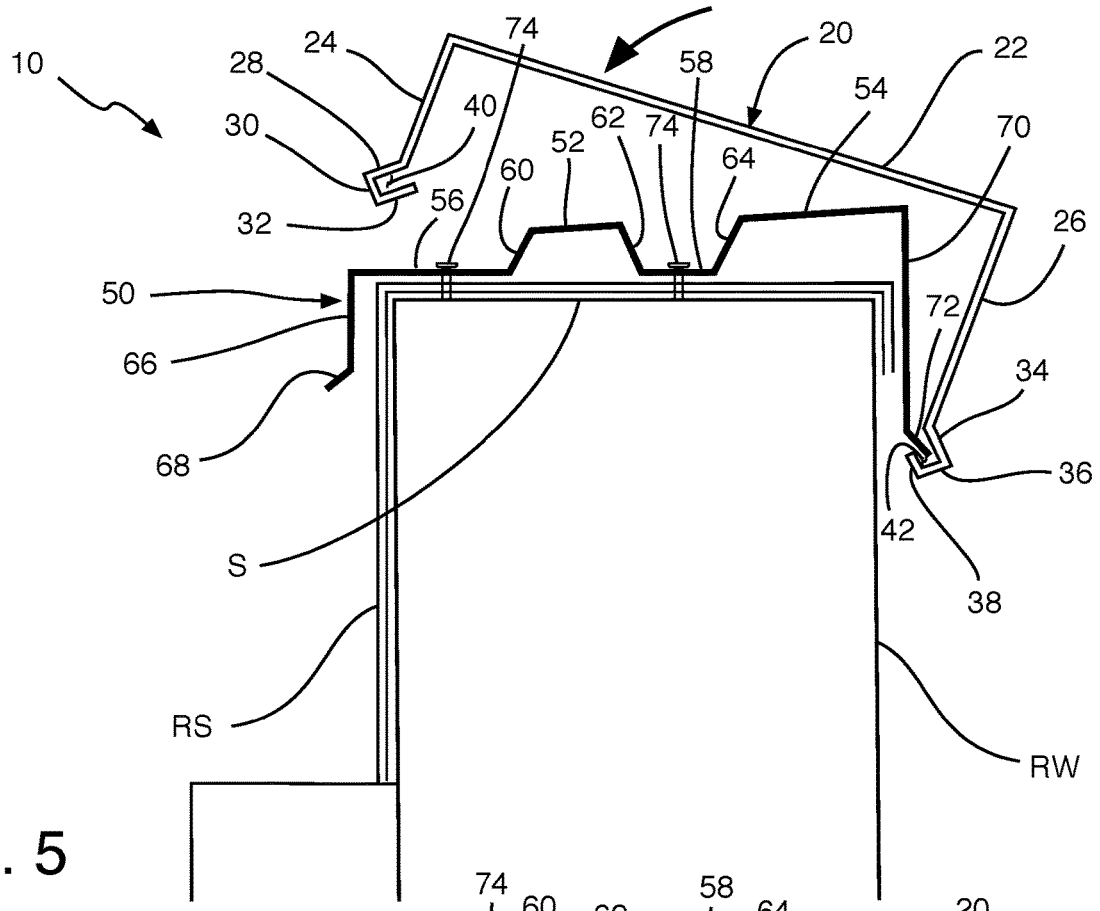
FIG. 5 illustrates a first step to secure the coping cap onto the coping cleat.
Figure 6:
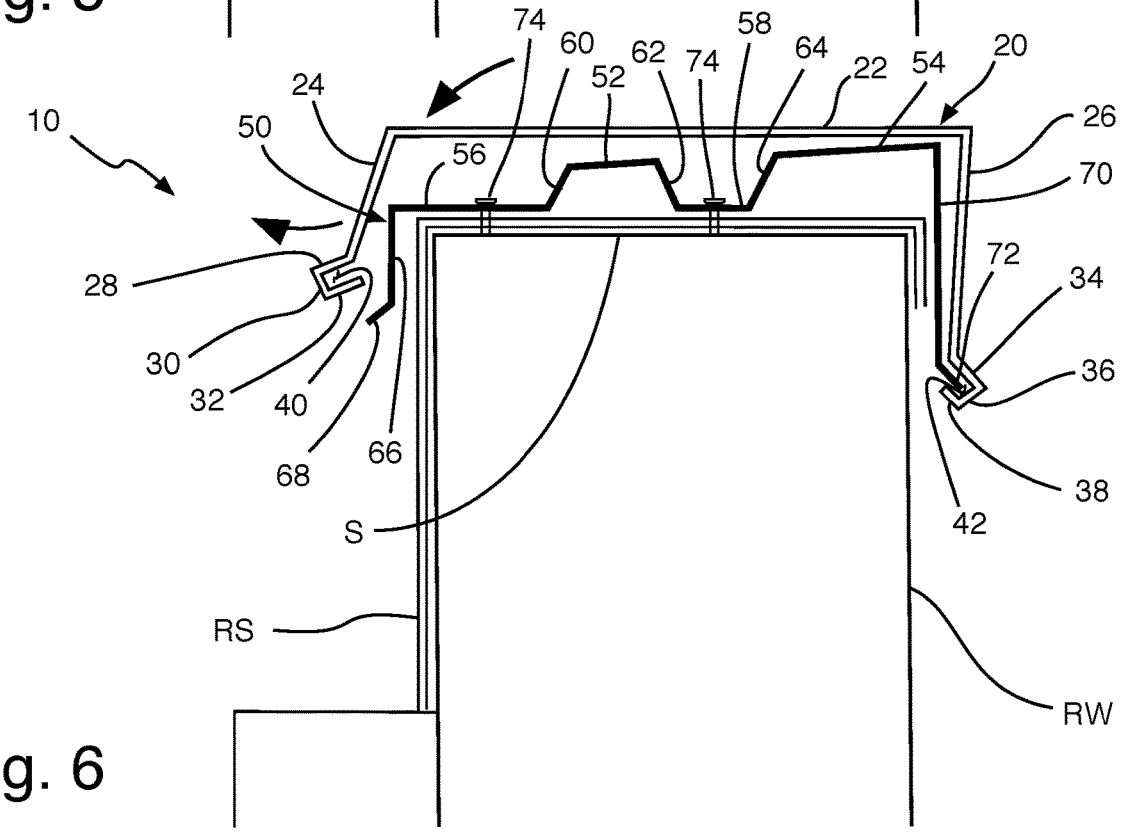
FIG. 6 illustrates a second step to secure the coping cap onto the coping cleat.

As seen in FIGS. 5 and 6, cleat coping 50 is mounted onto surface S having roof wall RW, whereby first lateral flange 66 is positioned at an interior side of roof wall RW. Cleat coping 50 is mounted onto surface S having roof wall RW by fastening means 74 through corner anchoring flange 56 and intermediate anchoring flange 58. Fastening means 74 may be, but are not limited to, nails, screws, bolts, glue, adhesives, etc.

Coping cap 20 is secured onto cleat coping 50, whereby side flange 24 is positioned at an interior side of roof wall RW, and side flange 26 is secured at an exterior side of roof wall RW onto lateral flange 70. In the securing process, coping cap 20 is first secured onto cleat coping 50 at the exterior side, whereby channel 42 receives locking tab 72.

Figure 7:
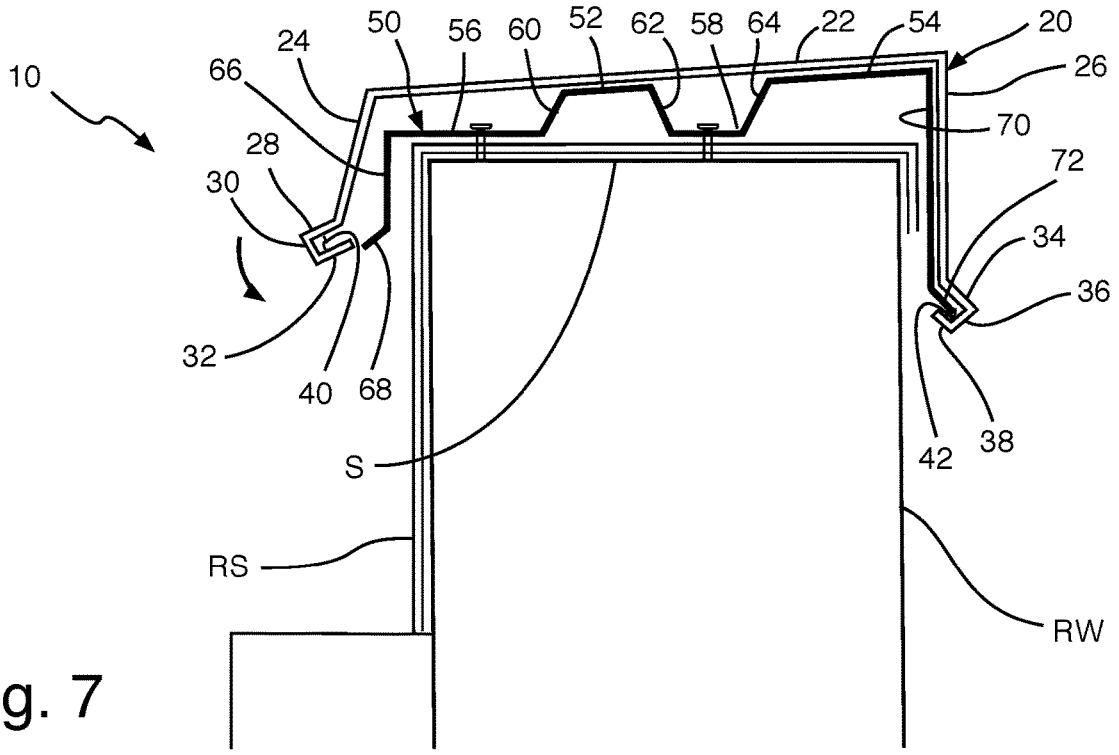
FIG. 7 illustrates a third step to secure the coping cap onto the coping cleat.
Figure 8:
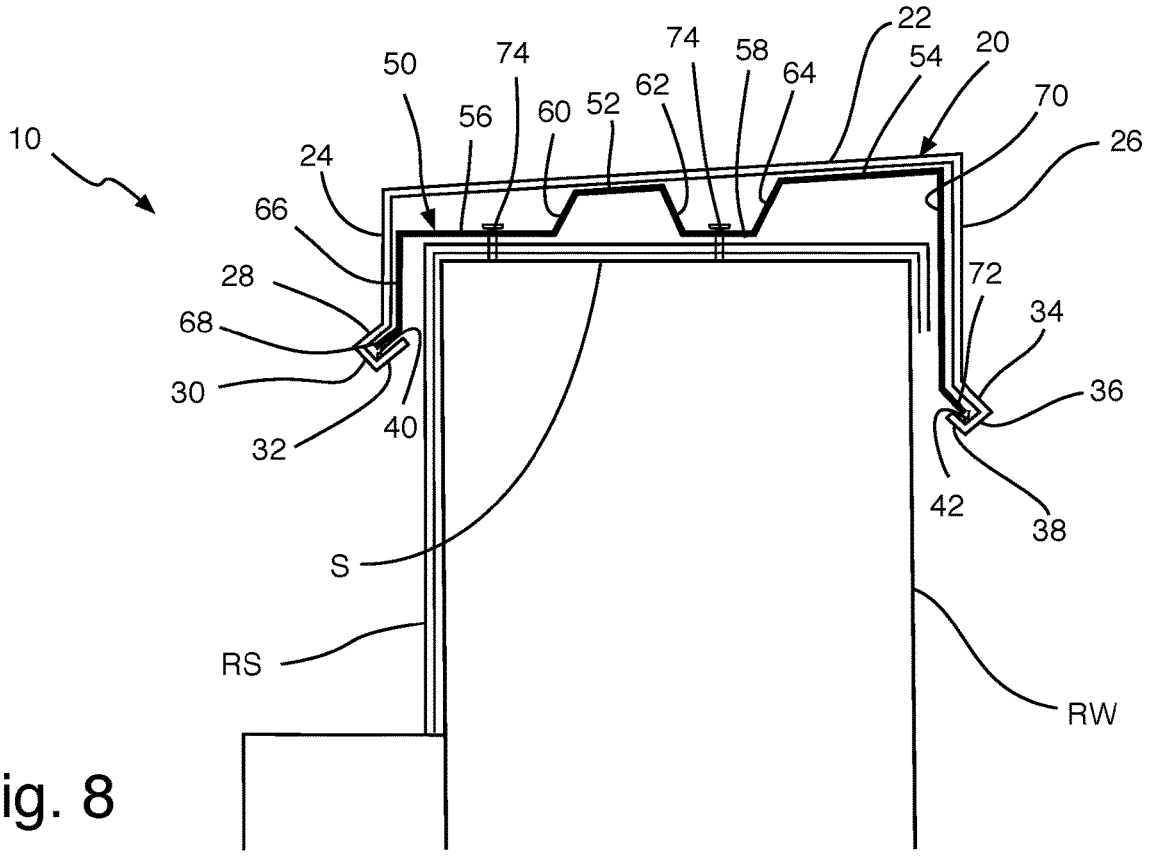
FIG. 8 illustrates a final step to secure the coping cap onto the coping cleat.

As seen in FIGS. 7 and 8, coping cap 20 is secured onto cleat coping 50, wherein second channel 42 receives second locking tab 72. Once locking tab 72 is secured within second channel 42, side flange 24 is positioned at the interior side of roof wall RW as cap top flange 22 mounts onto first and second top flanges 52 and 54, and then first channel 40 receives first locking tab 68. Thus, securing coping cap 20 onto cleat coping 50.

Once coping cap 20 is secured onto coping cleat 50 that is mounted onto surface S having roof wall RW, cap top flange 22, top flange 52, and top flange 54 are relatively parallel and define a predetermined angle with respect to surface S. It is noted that the predetermined angle slopes downwardly towards the interior side of roof wall RW so that water landing onto coping cap will tend to travel towards the interior side of roof wall RW by gravity. In a preferred embodiment, coping cleat 50 is mounted onto surface S having roof sealant RS. In a preferred embodiment, coping cap 20 and coping cleat 50 are made of a durable, weather resistant, and flexible metal for assembly.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A metal blocking with coping with cleat comprising:

A) a coping cap having a cap top flange, and first and second side flanges having first and second channels respectively at respective ends, said first channel is defined by a first exterior cleat strip, a first base cleat strip, and a first interior cleat strip, and said second channel is defined by a second exterior cleat strip, a second base cleat strip, and a second interior cleat strip, said first and second base cleat strips are perpendicular to said first and second exterior cleat strips respectively, and to said first and second interior cleat strips respectively; and B) a coping cleat having first and second top flanges, a corner anchoring flange, and an intermediate anchoring flange.

2. The metal blocking with coping with cleat set forth in claim 1, further characterized in that said first side flange has a first predetermined height and said second side flange has a second predetermined height, wherein said first predetermined height is shorter than said second predetermined height.

3. The metal blocking with coping with cleat set forth in claim 1, further characterized in that said first and second exterior cleat strips extend outwardly from said first and second side flanges respectively.

4. The metal blocking with coping with cleat set forth in claim 1, further characterized in that said first and second exterior cleat strips are parallel to said first and second interior cleat strips respectively.

5. The metal blocking with coping with cleat set forth in claim 2, further characterized in that said first interior cleat strip comprises a third predetermined height and said second interior cleat strip comprises a fourth predetermined height, whereby said fourth predetermined height is shorter than said third predetermined height.

6. The metal blocking with coping with cleat set forth in claim 5, further characterized in that said coping cleat further comprises first and second lateral flanges having first and second locking tabs respectively, whereby said first and second locking tabs extend outwardly.

7. The metal blocking with coping with cleat set forth in claim 1, further characterized in that said first top flange is positioned between said corner anchoring flange and said intermediate anchoring flange.

8. The metal blocking with coping with cleat set forth in claim 6, further characterized in that said first lateral flange perpendicularly extends from said corner anchoring flange, and said second lateral flange perpendicularly extends from said second top flange.

9. The metal blocking with coping with cleat set forth in claim 1, further characterized in that said intermediate anchoring flange is positioned between said first top flange and said second top flange.

10. The metal blocking with coping with cleat set forth in claim 1, further characterized in that said corner anchoring flange has a first predetermined width and said intermediate anchoring flange has a second predetermined width, wherein said first predetermined width is wider than said second predetermined width.

11. The metal blocking with coping with cleat set forth in claim 10, further characterized in that said first top flange has a third predetermined width and said second top flange has a fourth predetermined width, wherein said fourth predetermined width is wider than said third predetermined width.

12. The metal blocking with coping with cleat set forth in claim 1, further characterized in that said coping cleat further comprises first and second panels extending from said corner anchoring flange and said intermediate anchoring flange respectively to said first top flange.

13. The metal blocking with coping with cleat set forth in claim 12, further characterized in that said coping cleat further comprises a third panel extending from said intermediate anchoring flange to said second top flange.

14. The metal blocking with coping with cleat set forth in claim 6, further characterized in that said first lateral flange has a fifth predetermined height and said second lateral flange comprises a sixth predetermined height, wherein said fifth predetermined height is shorter than said sixth predetermined height.

15. The metal blocking with coping with cleat set forth in claim 6, wherein said cleat coping mounts onto a surface having a roof wall, whereby first lateral flange is positioned at an interior side of said roof wall.

16. The metal blocking with coping with cleat set forth in claim 15, further characterized in that said cleat coping is mounted onto said surface having said roof wall through said corner anchoring flange and said intermediate anchoring flange.

17. The metal blocking with coping with cleat set forth in claim 15, further characterized in that said coping cap is secured onto said cleat coping, whereby said first side flange is positioned at said interior side of said roof wall, and said second side flange is secured at an exterior side of said roof wall onto said second lateral flange, wherein said coping cap is first secured onto said cleat coping at said exterior side, whereby said second channel receives said second locking tab.

18. The metal blocking with coping with cleat set forth in claim 15, further characterized in that when once said coping cap is secured onto said coping cleat that is mounted onto said surface having said roof wall, said cap top flange, and said first and second top flanges are parallel and define a predetermined angle with respect to said surface.

* * * * *